US005529868A

United States Patent [19]

Mashimo et al.

[11] Patent Number: 5,529,868

[45] Date of Patent: Jun. 25, 1996

[54] ELECTROPHOTOGRAPHIC PHOTORECEPTOR

[75] Inventors: Kiyokazu Mashimo; Fumio Ojima; Tomozumi Uesaka; Toru Ishii; Kazuyuki Nakamura; Takahiro Suzuki, all of Minami-ashigara, Japan

[73] Assignee: Fuji Xerox Co., Ltd., Tokyo, Japan

[21] Appl. No.: 402,382

[22] Filed: Mar. 13, 1995

[30] Foreign Application Priority Data

Mar. 23, 1994 [JP] Japan ..... 6-075520
Mar. 25, 1994 [JP] Japan ..... 6-077776

[51] Int. Cl.[6] ..... G03G 5/047

[52] U.S. Cl. ..... 430/59; 430/78

[58] Field of Search ..... 430/57, 58, 78, 430/59

[56] References Cited

U.S. PATENT DOCUMENTS 5,085,961 2/1992 Gregory et al. ..... 430/58
5,418,101 5/1995 Holmes et al. ..... 430/57

FOREIGN PATENT DOCUMENTS 55-59483 5/1980 Japan .
57-122444 7/1982 Japan .
57-195254 11/1982 Japan .
59-9049 2/1984 Japan .
60-172044 9/1985 Japan .
62-247374 10/1987 Japan .
63-148263 6/1988 Japan .
1-118137 5/1989 Japan .
2-190862 7/1990 Japan .
2-178668 7/1990 Japan .
3-101739 4/1991 Japan .
3-127765 5/1991 Japan .
6-75408 3/1994 Japan .
6-95405 4/1994 Japan .

*Primary Examiner*—John Goodrow
*Attorney, Agent, or Firm*—Oliff & Berridge

[57] ABSTRACT

An electrophotographic photoreceptor comprising a conductive substrate having provided thereon a photosensitive layer, wherein said photosensitive layer contains, as charge transporting material (i) at least one triarylamine compound represented by formula (I)

(I)

wherein the definition of $Ar_1$, $Ar_2$ are described in the present specification; and (ii) at least one benzidine compound represented by formula (II)

(II)

wherein the definition of $R_1$, $R_1'$, $R_2$, $R_2'$, $R_3$, $R_3'$, m and n is described in the specification. The photoreceptor maintains its electrical characteristics stably on repeated use.

12 Claims, 1 Drawing Sheet

ELECTROPHOTOGRAPHIC PHOTORECEPTOR

FIELD OF THE INVENTION

This invention relates to an electrophotographic photoreceptor and more particularly to a highly durable electrophotographic photoreceptor excellent in photosensitivity, printing characteristics, abrasion resistance, cleanability, and environmental stability.

BACKGROUND OF THE INVENTION

Photoreceptors conventionally widespread in electrophotography are those comprising inorganic photoconductive materials, such as selenium, selenium-tellurium alloys, selenium-arsenic alloys, and cadmium sulfide.

Organic photoreceptors comprising organic photoconductive materials have also been studied with attention being paid on their merits over inorganic photoreceptors, such as inexpensiveness, productivity, and ease of disposal. In particular, organic photoreceptors of separate function type having a laminate structure composed of a charge generating layer which functions to generate charge on exposure to light and a charge transporting layer which functions to transport the generated charge are excellent in electrophotographic characteristics, such as sensitivity, charging properties, and stability of these properties on repeated use. Various proposals on this type of photoreceptors have been made to date, and some of them have been put to practical use.

While organic laminate type photoreceptors exhibiting satisfactory performance in terms of the above-mentioned electrophotographic characteristics have been developed, there still remains an unsolved problem of durability against mechanical outer force in nature of the organic material used. That is, being made of an organic material, an organic photosensitive layer easily undergoes wear or scratches on direct imposition of loads from a toner, a developer, a transfer medium (e.g., paper), a cleaning member, and the like and tends to suffer from adhesion of foreign substances due to, for example, a toner filming phenomenon, which results in image defects. Besides, low-resistant substances, such as corona discharge-induced ozone and nitrogen oxides, and paper dust from copying paper are liable to be deposited on the surface of the photoreceptor, which leads to image diffusion under a high temperature condition. The working life of an organic photoreceptor has been considerably limited by these phenomena.

On the other hand, it has been demanded to achieve speeding up in formation of a color image with full color copying machines and color printers.

A number of measures have ever been proposed to improve durability of an electrophotographic photoreceptor. For example, various polycarbonate resins have been suggested as a binder resin for the surface layer of a photoreceptor (see JP-A-60-172044, JP-A-62-247374, and JP-A-63-148263; the term "JP-A" as used herein means an "unexamined published Japanese patent application"). Various charge transporting materials to be used in the charge transporting layer have also been proposed. For example, JP-B-59-9049 (the term "JP-B" as used herein means an "examined published Japanese patent application") and JP-A-62-247374 disclose benzidine compounds, and JP-A-2-178668, JP-A-2-190862, JP-A-3-101739, and JP-A-3-127765 disclose triarylamine compounds.

While durability of a photoreceptor can be improved by a proper choice of the binder resins proposed, the improvement so far achieved is still unsatisfactory. That is, even if the coating film made of a known binder resin has sufficient mechanical strength, once toner filming occurs on a photoreceptor as a result of insufficient cleaning, image quality cannot be restored unless the photoreceptor is exchanged for a new one. Further, some binder resins proposed for improvement of durability impair photosensitivity of a photoreceptor.

The charge transporting materials proposed to date, when used repeatedly, suffer from reduction in charge potential and increase in potential at an exposed portion and also cause fog, resulting in deterioration of image quality.

The demand for high image quality has been increasing as is seen from the recent advancement of full color copying machines, and it has been getting difficult for known techniques to meet the demand. Therefore, it has been demanded to improve cleanability of a photoreceptor. Further, since many steps and expenses would be required for eliminating minute defects occurring in the photosensitive layer of a photoreceptor, the manufactures have been compelled to accept occurrence of defects to some extent so as to supply their products at competitive prices. It follows that copies obtained suffer from fine black spots on the white background or fine blank areas on the image area. These image defects may no more be ignored in the case where an image extends all over paper like full color copies.

SUMMARY OF THE INVENTION

An object of the present invention is to provide an electrophotographic photoreceptor which exhibits high photosensitivity and excellent cleanability even when used repeatedly and is therefore suitable for full color copying machines.

The present invention provides an electrophotographic photoreceptor comprising a conductive substrate having provided thereon a photosensitive layer, wherein the photosensitive layer contains, as charge transporting materials, (i) at least one triarylamine compound represented by formula (I):

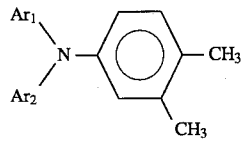

(I)

wherein $Ar_1$ and $Ar_2$ each represents a phenyl group which may be substituted with a substituent selected from the group consisting of an alkyl group (preferably having 1 or 2 carbon atoms), a phenyl group, an alkoxy group (preferably having 1 or 2 carbon atoms) which may be substituted with a fluorine atom, an alkyl(preferably methyl)-substituted amino group and an alkyl(preferably methyl)-substituted phenyl group; a polycyclic aromatic group (preferably having 2 to 4 aromatic rings) which may be substituted with an alkyl group (preferably having 1 or 2 carbon atoms); or an aromatic heterocyclic group (preferably having a 5 or 6-membered ring);

and (ii) at least one benzidine compound represented by formula (II):

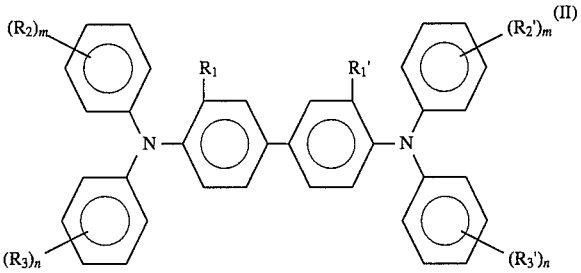

wherein $R_1$ and $R_1'$ are the same or different and each represents a hydrogen atom, a halogen atom, an alkyl group (preferably having 1 to 4 carbon atoms) or an alkoxy group (preferably having 1 to 4 carbon atoms); $R_{2,\ R2}'$, $R_3$, and $R_3'$ are the same or different and each represents a hydrogen atom, a halogen atom, an alkyl group (preferably having 1 to 4 carbon atoms, more preferably 1 or 2 carbon atoms), an alkoxy group (preferably having 1 to 4 carbon atoms, more preferably 1 or 2 carbon atoms) or a substituted amino group; and m and n each represent 1 or 2.

Preferred examples of the substituted amino group of $R_2$, $R_2'$, $R_3$, and $R_3'$ in formula (II) include N,N-diphenylamino group and N,N-di(4-methyl-phenyl)amino group.

In a preferred embodiment of the present invention, the photosensitive layer has a separate function type laminate structure composed of a charge generating layer and a charge transporting layer, and the charge transporting layer contains the triarylamine compound of formula (I) and the benzidine compound of formula (II).

In another preferred embodiment of the present invention, the photosensitive layer further contains a hindered phenol compound or a hindered amine compound as an antioxidant. Addition of the antioxidant is effective to suppress development of image defects to provide an electrophotographic photoreceptor suited to high performance copying machines.

DETAILED DESCRIPTION OF THE INVENTION

The electrophotographic photoreceptor according to the present invention may have either a single layer structure or a separate function type laminate structure composed of a charge generating layer and a charge transporting layer. In what follows, the present invention is described by referring chiefly to the separate function type laminate structure.

Figure 1:
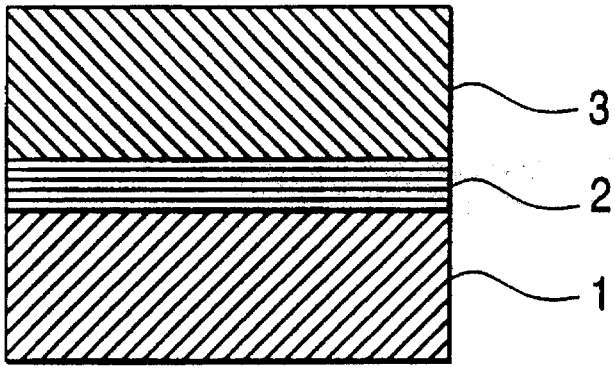
FIGS. 1 and 2 each illustrates a schematic cross section of an electrophotographic photoreceptor according to the present invention.
Figure 2:
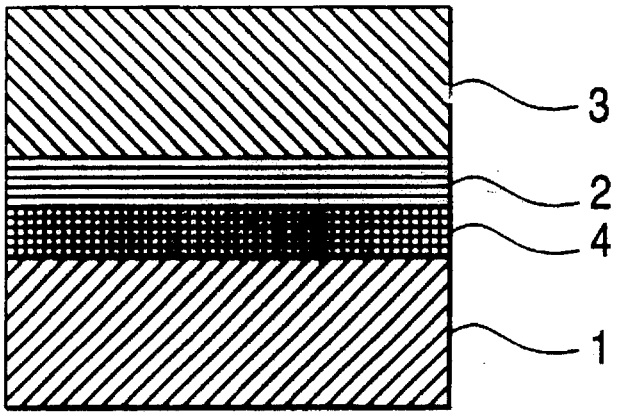

In FIGS. 1 and 2 is shown a schematic cross section of the laminate type electrophotographic photoreceptor according to the present invention. The photoreceptor of FIG. 1 comprises conductive substrate 1 having thereon a photosensitive layer composed of charge generating layer 2 and charge transporting layer 3. The photoreceptor of FIG. 2 additionally has subbing layer 4 between conductive substrate 1 and charge generating layer 2.

The conductive substrate which can be used in the present invention includes metals, e.g., aluminum, nickel, chromium, stainless steel, etc.; plastic films having a conductive thin film of aluminum, titanium, nickel, chromium, stainless steel, gold, vanadium, tin oxide, indium oxide or indium-tin oxide (ITO); and paper or plastic films coated or impregnated with a conductivity-imparting material. While not limiting, these substrate materials are usually used in a drum form, a sheet form or a plate form. If desired, the conductive substrate may be subjected to various surface treatments as far as image quality is not impaired. Suitable surface treatments include oxidation, chemical treatments, coloring, and treatments for irregular reflection, such as surface graining.

The charge generating layer comprises a binder resin having dispersed therein a charge generating material. Suitable charge generating materials include inorganic photoconductive materials, e.g., amorphous selenium, crystalline selenium-tellurium alloys, other selenium compounds and alloys, zinc oxide, and titanium oxide; and organic pigments or dyes, e.g., phthalocyanine type, squarylium type, anthanthrone type, perylene type, azo type, anthraquinone type, pyrene type, pyrylium salts, and thiapyrylium salts.

Binder resins which can be used in the charge generating layer include, while not limiting, polyvinyl butyral resins, polyvinyl formal resins, partially modified polyvinyl acetal resins, polycarbonate resins, polyester resins, acrylic resins, polyvinyl chloride resins, polystyrene resins, polyvinyl acetate resins, vinyl chloride-vinyl acetate copolymers, silicone resins, phenolic resins, and poly-N-vinylcarbazole resins. These binder resins may be used either individually or as a combination of two or more thereof.

A suitable mixing ratio of a charge generating material to a binder resin is from 5:1 to 1:2 by volume. The charge generating layer usually has a thickness of 0.1 to 5 μm, preferably 0.2 to 2.0 μm. Coating of a coating composition comprising a charge generating material, a binder resin, and a solvent can be carried out by any of known techniques, such as blade coating, wire bar coating, spray coating, dip coating, bead coating, air knife coating, and curtain coating.

Suitable solvents to be used in the coating composition include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, and chloroform. These organic solvents may be used either individually or as a combination of two or more thereof.

The charge transporting layer according to the present invention comprises a binder resin having dispersed therein at least one triarylamine compound of formula (I) and at least one benzidine compound of formula (II) as charge transporting materials and, if desired, an antioxidant.

Specific examples of the triarylamine compound of formula (I) and the benzidine compound of formula (II) are shown in Tables 1 and 2, respectively.

TABLE 1

| | $Ar_1$ | $Ar_2$ |
|---|---|---|
| I-1 | 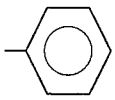 | 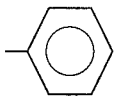 |
| 2 | 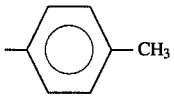  | 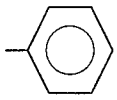 |

TABLE 1-continued
| | $Ar_1$ | $Ar_2$ |
|---|---|---|
| 3 | 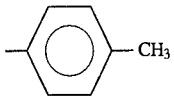 | 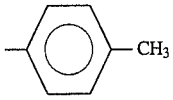 |
| 4 | 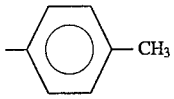 | 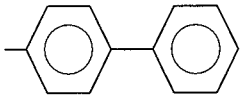 |
| 5 | 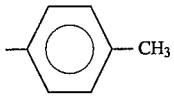 | 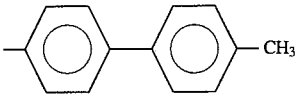 |
| 6 | 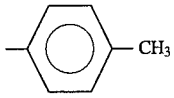 | 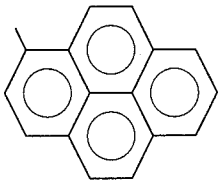 |
| 7 | 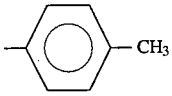 | 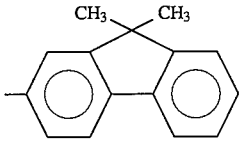 |
| 8 | 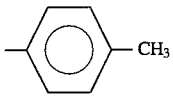 | 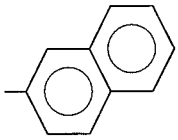 |
| 9 | 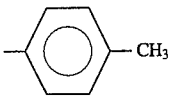 | 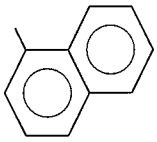 |
| 10 | 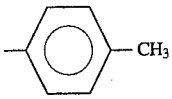 | 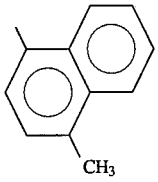 |
| 11 | 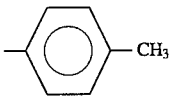 | 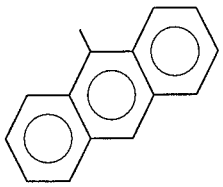 |
| 12 | 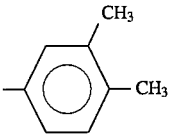 | 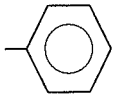 |
TABLE 1-continued
| | $Ar_1$ | $Ar_2$ |
|---|---|---|
| 13 | 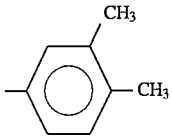 | 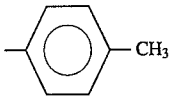 |
| 14 | 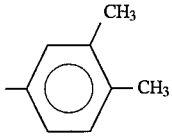 | 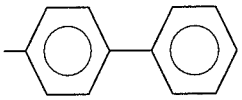 |
| 15 | 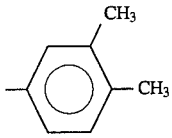 | 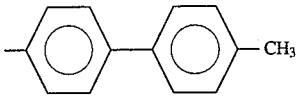 |
| 16 | 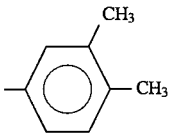 | 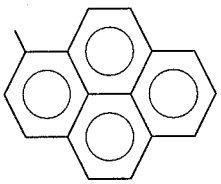 |
| 17 | 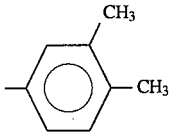 | 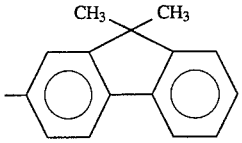 |
| 18 | 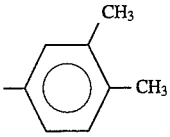 | 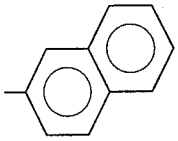 |
| 19 | 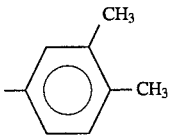 | 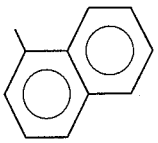 |
| 20 | 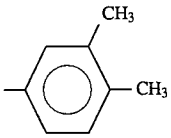 | 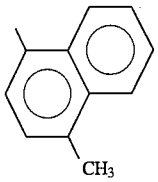 |
| 21 | 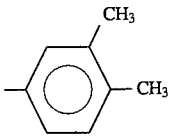 | 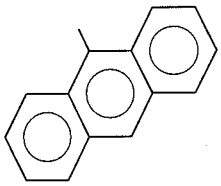 |
| 22 | 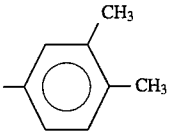 | 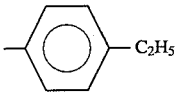 |

TABLE 1-continued

| | $Ar_1$ | $Ar_2$ |
|---|---|---|
| 23 | 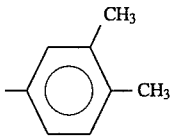 | 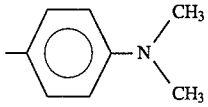 |
| 24 | 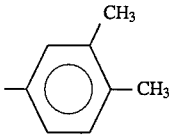 | 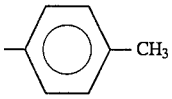 |
| 25 | 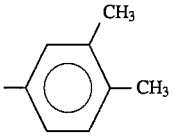 | 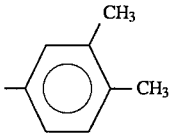 |
| 26 | 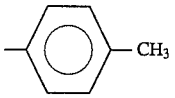 | 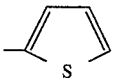 |
| 27 | 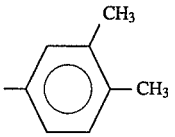 | 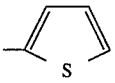 |
| 28 | 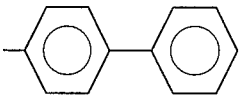 | 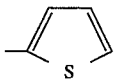 |
| 29 | 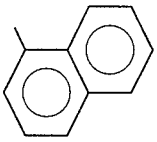 | 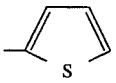 |
| 30 | 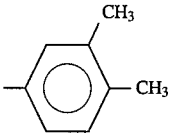 | 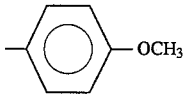 |
| 31 | 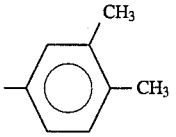 | 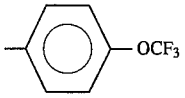 |
| 32 | 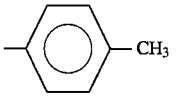 | 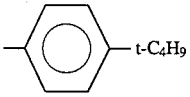 |
| 33 | 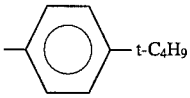 | 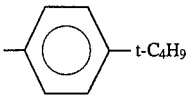 |
| 34 | 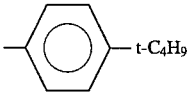 | 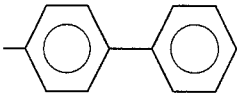 |

TABLE 1-continued

| | $Ar_1$ | $Ar_2$ |
|---|---|---|
| 35 | 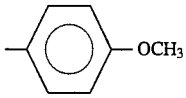 | 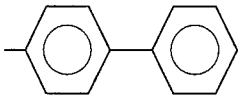 |
| 36 | 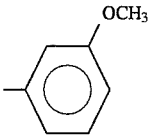 | 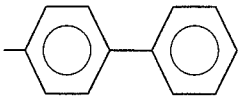 |
| 37 | 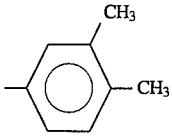 | 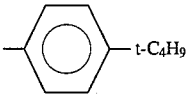 |
| 38 | 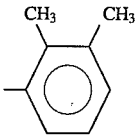 | 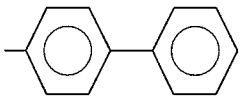 |

TABLE 2

| Compound No. | $R_1$, $R_1'$, | $R_2$, $R_2'$ | $R_3$, $R_3'$ |
|---|---|---|---|
| II-1 | $CH_3$ | H | H |
| II-2 | $CH_3$ | 2-$CH_3$ | H |
| II-3 | $CH_3$ | 3-$CH_3$ | H |
| II-4 | $CH_3$ | 4-$CH_3$ | H |
| II-5 | $CH_3$ | 4-$CH_3$ | 2'-$CH_3$ |
| II-6 | $CH_3$ | 4-$CH_3$ | 3'-$CH_3$ |
| II-7 | $CH_3$ | 4-$CH_3$ | 4'-$CH_3$ |
| II-8 | $CH_3$ | 3,4-$CH_3$ | H |
| II-9 | $CH_3$ | 3,4-$CH_3$ | 3',4'-$CH_3$ |
| II-10 | $CH_3$ | 4-$C_2H_5$ | H |
| II-11 | $CH_3$ | 4-$C_3H_7$ | H |
| II-12 | $CH_3$ | 4-$C_4H_9$ | H |
| II-13 | $CH_3$ | 4-$C_2H_5$ | 2'-$CH_3$ |
| II-14 | $CH_3$ | 4-$C_2H_5$ | 3'-$CH_3$ |
| II-15 | $CH_3$ | 4-$C_2H_5$ | 4'-$CH_3$ |
| II-16 | $CH_3$ | 4-$C_2H_5$ | 3',4'-$CH_3$ |
| II-17 | $CH_3$ | 4-$C_3H_7$ | 3'-$CH_3$ |
| II-18 | $CH_3$ | 4-$C_3H_7$ | 4'-$CH_3$ |
| II-19 | $CH_3$ | 4-$C_4H_9$ | 3'-$CH_3$ |
| II-20 | $CH_3$ | 4-$C_4H_9$ | 4'-$CH_3$ |
| II-21 | $CH_3$ | 4-$C_2H_5$ | 4'-$C_2H_5$ |
| II-22 | $CH_3$ | 4-$C_2H_5$ | 4'-$OCH_3$ |
| II-23 | $CH_3$ | 4-$C_3H_7$ | 4'-$C_3H_7$ |
| II-24 | $CH_3$ | 4-$C_3H_7$ | 4'-$OCH_3$ |
| II-25 | $CH_3$ | 4-$C_4H_9$ | 4'-$C_4H_9$ |
| II-26 | $CH_3$ | 4-$C_4H_9$ | 4'-$OCH_3$ |
| II-27 | H | 3-$CH_3$ | H |
| II-28 | Cl | H | H |
| II-29 | Cl | 2-$CH_3$ | H |
| II-30 | Cl | 3-$CH_3$ | H |
| II-31 | Cl | 4-$CH_3$ | H |
| II-32 | Cl | 4-$CH_3$ | 2'-$CH_3$ |
| II-33 | Cl | 4-$CH_3$ | 3'-$CH_3$ |
| II-34 | Cl | 4-$CH_3$ | 4'-$CH_3$ |
| II-35 | $C_2H_5$ | H | H |
| II-36 | $C_2H_5$ | 2-$CH_3$ | H |
| II-37 | $C_2H_5$ | 3-$CH_3$ | H |
| II-38 | $C_2H_5$ | 4-$CH_3$ | H |
| II-39 | $C_2H_5$ | 4-$CH_3$ | 4'-$CH_3$ |
| II-40 | $C_2H_5$ | 4-$C_2H_5$ | 4'-$CH_3$ |
| II-41 | $C_2H_5$ | 4-$C_3H_7$ | 4'-$CH_3$ |
| II-42 | $C_2H_5$ | 4-$C_4H_9$ | 4'-$CH_3$ |
| II-43 | $OCH_3$ | H | H |
| II-44 | $OCH_3$ | 2-$CH_3$ | H |

TABLE 2-continued

| Compound No. | $R_1$, $R_1'$, | $R_2$, $R_2'$ | $R_3$, $R_3'$ |
|---|---|---|---|
| II-45 | $OCH_3$ | 3-$CH_3$ | H |
| II-46 | $OCH_3$ | 4-$CH_3$ | H |
| II-47 | $OCH_3$ | 4-$CH_3$ | 4'-$CH_3$ |
| II-48 | $OCH_3$ | 4-$C_2H_5$ | 4'-$CH_3$ |
| II-49 | $OCH_3$ | 4-$C_3H_7$ | 4'-$CH_3$ |
| II-50 | $OCH_3$ | 4-$C_4H_9$ | 4'-$CH_3$ |
| II-51 | $CH_3$ | 2-$N(CH_3)_2$ | H |
| II-52 | $CH_3$ | 3-$N(CH_3)_2$ | H |
| II-53 | $CH_3$ | 4-$N(CH_3)_2$ | H |
| II-54 | $CH_3$ | 4-Cl | H |

The charge transporting layer may further contain a triarylamine compound other than the triarylamine compounds of formula (I). Examples of usable other triarylamine compounds are represented by formula (III):

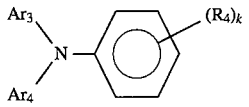

(III)

wherein $Ar_3$ and $Ar_4$ each represents a phenyl group which may be substituted with a substituent selected from the group consisting of an alkyl group (preferably having 1 to 4 carbon atoms), a phenyl group, an alkoxy group (preferably having 1 to 4 carbon atoms) and an alkyl(preferably having 1 to 4 carbon atoms)-substituted phenyl group, or a naphthyl group; $R_4$ represents an alkyl group having 1 to 4 carbon atoms or an alkoxy group (preferably having 1 to 4 carbon atoms); and k represents 0, 1 or 2.

Specific examples of the triarylamine compounds of formula (III) are shown in Table 3 below.

TABLE 3

| | $(R_4)_k$ | $Ar_3$ | $Ar_4$ |
|---|---|---|---|
| III-1 | H | 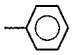 | 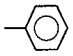 |
| 2 | H | 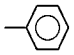 | 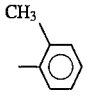 |
| 3 | H | 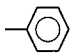 | 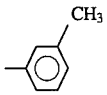 |
| 4 | H | 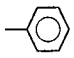 | 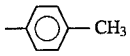 |
| 5 | H | 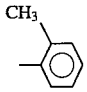 | 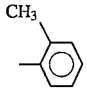 |
| 6 | H | 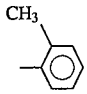 | 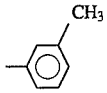 |
| 7 | H | 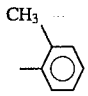 | 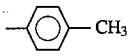 |

TABLE 3-continued

| | $(R_4)_k$ | $Ar_3$ | $Ar_4$ |
|---|---|---|---|
| 8 | H | 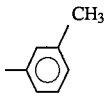 | 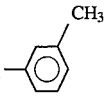 |
| 9 | H | 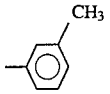 | 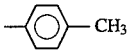 |
| 10 | H | 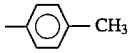 | 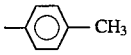 |
| 11 | 2-$CH_3$ | 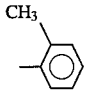 | 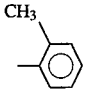 |
| 12 | 2-$CH_3$ | 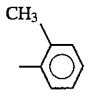 | 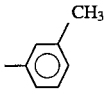 |
| 13 | 2-$CH_3$ | 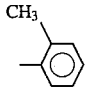 | 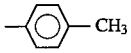 |
| 14 | 2-$CH_3$ | 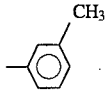 | 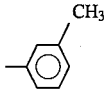 |
| 15 | 2-$CH_3$ | 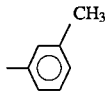 | 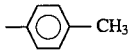 |
| 16 | 2-$CH_3$ | 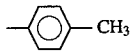 | 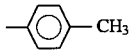 |
| 17 | 3-$CH_3$ | 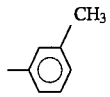 | 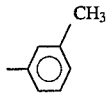 |
| 18 | 3-$CH_3$ | 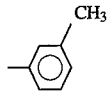 | 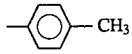 |
| 19 | 3-$CH_3$ | 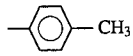 | 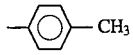 |
| 20 | 4-$CH_3$ | 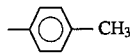 | 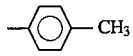 |
| 21 | 2,4-$CH_3$ | 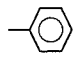 | 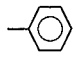 |
| 22 | 2,4-$CH_3$ | 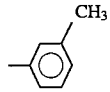 | 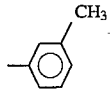 |
| 23 | 2,4-$CH_3$ | 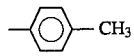 | 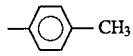 |
| 24 | 3,5-$CH_3$ | 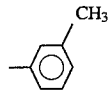 | 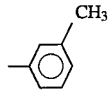 |

TABLE 3-continued

| | $(R_4)_k$ | $Ar_3$ | $Ar_4$ |
|---|---|---|---|
| 25 | 3,5-$CH_3$ | 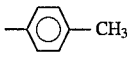 | 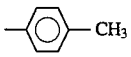 |
| 26 | H | 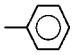 | 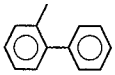 |
| 27 | H | 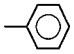 | 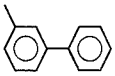 |
| 28 | H | 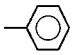 | 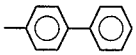 |
| 29 | 2-$CH_3$ | 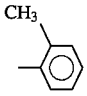 | 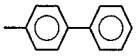 |
| 30 | 3-$CH_3$ | 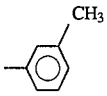 | 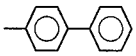 |
| 31 | 4-$CH_3$ | 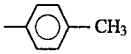 | 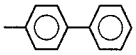 |
| 32 | 4-$OCH_3$ | 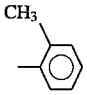 | 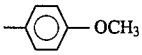 |
| 33 | 4-$OCH_3$ | 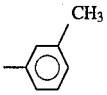 | 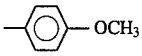 |
| 34 | 4-$OCH_3$ | 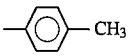 | 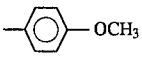 |
| 35 | 4-$C_2H_5$ | 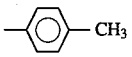 | 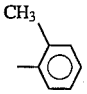 |
| 36 | 4-$C_2H_5$ | 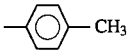 | 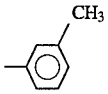 |
| 37 | 4-$C_2H_5$ | 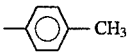 | 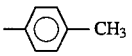 |
| 38 | 4-$CH_3$ | 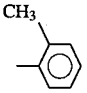 | 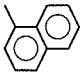 |
| 39 | 4-$CH_3$ | 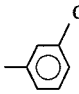 | 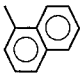 |
| 40 | 4-$CH_3$ | 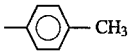 | 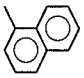 |
| 41 | 4-$CH(CH_3)_2$ | 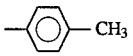 | 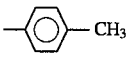 |
| 42 | 4-$CH(CH_3)_2$ | 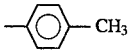 | 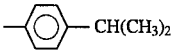 |

The triarylamine compound of formula (I) and the benzidine compound are used at a mixing ratio of 10:90 to 90:10, preferably 30:70 to 90:10, by weight. If the proportion of the triarylamine compound is lower than 30% by weight, the photoreceptor tends to have insufficient abrasion resistance and insufficient cleanability and to produce a noise of sliding with a cleaning member. When triarylamine compounds other than the compounds of formula (I) are used in combination, the proportion of the triarylamine compound of formula (I) should be at least 10% by weight, preferably 25% by weight or more, based on the total triarylamine compounds. If the proportion is lower than 25% by weight, the electrical characteristics tend to be reduced on repeated use.

A mixing ratio of the sum of (i) all the triarylamine compounds used and (ii) the benzidine compound to the binder resin is from 30:70 to 60:40 by weight. In order to assure satisfactory electrical characteristics, abrasion resistance, cleanability, and smooth sliding of a cleaning member, the above ratio is preferably from 35:65 to 50:50 by weight.

It is preferable that the charge transporting layer contains a hindered amine compound or a hindered phenol compound as an antioxidant. A wide range of generally known hindered amine compounds and hindered phenol compounds can be utilized; for the effects as antioxidant are independent on modifying substituents.

Specific examples of suitable hindered amine compounds are 4,4'-bis(α,α'-dimethylbenzyl)diphenylamine, N,N'-diphenyl-p-phenylenediamine, N-isopropyl-N'-phenyl-p-phenylenediamine, N-1,3-dimethyl-N'-phenyl-p-phenylenediamine, N-1-methylheptyl-N'-phenyl-p-phenylenediamine, N-(3-methacryloyloxy-2-hydroxypropyl)-N'-phenyl-p-phenylenediamine, 2,2,4-trimethyl-1,2-dihydroquinoline polymers, 6-ethoxy-2,2,4-trimethyl-1,2-dihydroquinoline, diphenylamine derivatives, and alkylated diphenylamine, e.g., octylated diphenylamine.

Specific examples of suitable hindered phenol compounds are triethylene glycol bis[3-(3-t-butyl-5-methyl-4-hydroxyphenyl)propionate], 1,6-hexanediol bis[3-(3,5-di-t-butyl-4-hydroxyphenyl)propionate], 2,4-bis(n-octylthio)-6-(4-hydroxy- 3,5-di-t-butylanilino)-1,3,5-triazine, pentaerythrityl tetrakis[3-(3,5-di-t-butyl-4-hydroxyphenyl)propionate], 2,2-thiodiethylene bis[3-(3,5-di-t-butyl- 4-hydroxyphenyl)propionate], octadecyl 3-(3,5-di-t-butyl- 4-hydroxyphenyl)propionate, N,N'-hexamethylenebis-3,5-di-t-butyl-4-hydroxyhydrocinnamide, diethyl 3,5-di-t-butyl-4-hydroxybenzylphosphonate, 1,3,5-trimethyl-2,4,6-tris(3,5-di-t-butyl- 4-hydroxybenzyl)benzene, calcium bis(ethyl 3,5-di-t-butyl- 4-hydroxybenzylphosphonate), tris(3,5-di-t-butyl-4-hydroxybenzyl) isocyanurate, 2,4-bis[(octylthio)methyl]-o-cresol, 2,6-di-t-butyl-4-methylphenol, 2,6-di-t-butyl-4-ethylphenol, styrenated phenol, 2,2'-methylenebis(4-ethyl-6-t-butylphenol), 2,2'-methylenebis(4-ethyl-6-t-butylphenol), 4,4'-butylidenebis(3-methyl-6-t-butylphenol), 2,5-di-t-butylhydroquinone, 2,5-di-t-amylhydroquinone, 2-t-butyl-6-(3-butyl- 2-hydroxy-5-methylbenzyl)-4-methylphenyl acrylate, 2-[1-(2-hydroxy-3,5-di-t-pentylphenyl) ethyl]-4,6-di-t-pentylphenyl acrylate, 4,4'-butylidenebis(3-methyl-6-t-butylphenol), 4,4'-thiobis(3-methyl-6-t-butylphenol), 4,4'-thiobis( 2-methyl-6-t-butylphenol), 3,9-bis{2-[3-(3-t-butyl-4-hydroxy-5-methylphenyl)propionyloxy]-1,1-dimethyl}-2,4,8,10-tetraoxaspiro[5,5]undecane, alkylated bisphenols, and other phenol derivatives.

In addition to these hindered amine antioxidants and/or hindered phenol antioxidants, other antioxidants including secondary antioxidants may also be used. Usable other antioxidants include organic sulfur antioxidants, such as dilauryl 3,3'-thiodipropionate, dimyristyl 3,3'-thiodipropionate, distyryl 3,3'-thiodipropionate, pentaerythrityl tetrakis(3-laurylthiopropionate), and ditridecyl 3,3'-thiodipropionate; phosphite antioxidants, such as triphenyl phosphite, trisnonylphenyl phosphite, tris(2,4-di-t-butylphenyl) phosphite, tris(2-ethylhexyl) phosphite, tridecyl phosphite, tris(tridecyl) phosphite, diphenyl(2-ethylhexyl) phosphite, diphenyldecyl phosphite, diphenyltridecyl phosphite, and tetraphenyldipropylene glycol diphosphite; dithiocarbamate antioxidants, such as nickel diethyldithiocarbamate and nickel dibutyldithiocarbamate; thiourea antioxidants, such as tributylthiourea and 1,3-bis(dimethylaminopropyl)-2-thiourea; and benzimidazole antioxidants, such as 2-mercaptobenzimidazole and 2-mercaptomethylbenzimidazole.

The antioxidants may be used in a total amount of 15% or less by weight, preferably 0.07 to 10% by weight, based on the layer to which they are added. In order to retain mechanical characteristics of the layer, it is preferable that the sum of the total charge transporting materials and the total antioxidants should not be more than 60% by weight, still preferably not more than 55% by weight, based on the layer to which they are added. Further, in order to suppress development of image defects, the total amount of the antioxidants is preferably at least 1/200 of the total weight of the charge transporting materials.

Binder resins which can be used in the charge transporting layer include, while not limiting, polycarbonate resins, polyester resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkyd resins, phenol-formaldehyde resins, styrene-acrylate resins, styrene-alkyd resins, poly-N-vinylcarbazole, and polysilane. These binder resins may be used either individually or as a combination of two or more thereof.

Of these binder resins, a polycarbonate resin having a structural unit represented by formulae (IV) to (IX) shown below or a copolycarbonate resin comprising these structural units, or a mixture thereof is preferred.

(IV)

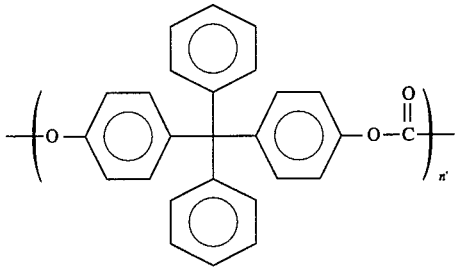

(V)

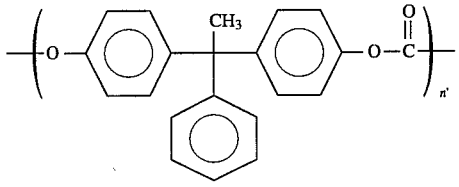

-continued (VI)

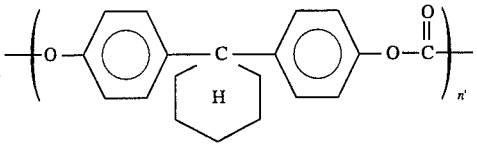

(VII)

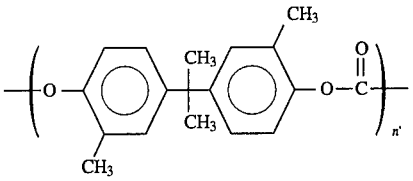

(VIII)

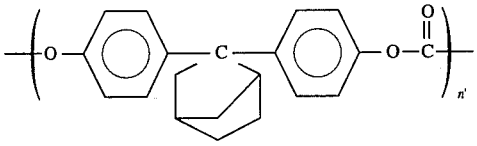

(IX)

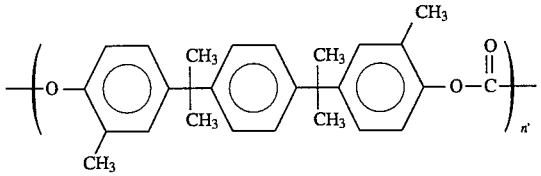

wherein n' represents a degree of polymerization within the range of molecular weight hereinafter specified.

The above-mentioned polycarbonate resins have good compatibility with charge transporting materials and other components to provide a uniform coating film exhibiting satisfactory characteristics. A preferred viscosity-average molecular weight of these polycarbonate resins ranges from 10,000 to 100,000, still preferably 10,000 to 50,000.

Additives mainly for improving surface properties may be added to the photosensitive layer. Compounds generally known as modifiers for coatings can be used for this purpose. Examples of suitable additives include alkyl-modified silicone oils, such as dimethylsilicone oil, and aromatic modified silicone oils, such as methylphenylsilicone oil. These additives are used in an amount of 1 to 10,000 ppm, preferably 5 to 2,000 ppm, based on the solids content of the charge transporting layer.

The charge transporting layer can be formed by applying a coating composition comprising a binder resin, a charge transporting material, an antioxidant, etc. dissolved in an appropriate solvent on a conductive substrate and removing the solvent from the coating layer by evaporation.

Suitable solvents to be used in the charge transporting layer formation include aromatic hydrocarbons, e.g., benzene, toluene, xylene, and chlorobenzene; halogenated aromatic hydrocarbons, e.g., monochlorobenzene; ketones, e.g., acetone and 2-butanone; halogenated aliphatic hydrocarbons, e.g., methylene chloride, chloroform, and ethylene chloride; cyclic or acyclic ethers, e.g., tetrahydrofuran, ethyl ether, and dioxane; and mixtures thereof.

The same coating techniques as used for the charge generating layer formation apply to the charge transporting layer formation.

The charge transporting layer usually has a thickness of from 5 to 50 μm, and preferably from 10 to 30 μm.

Where a photosensitive layer has a single layer structure, a photosensitive layer comprises a charge generating material, a charge transporting material, and a binder resin. The charge generating materials and charge transporting materials to be used are the same as those described above with reference to a laminate type photosensitive layer. The same polycarbonate resin systems as described for the charge transporting layer of the laminate type photosensitive layer can be used as a binder resin. The polycarbonate resin may be used in combination with up to 50% by weight, based on the total binder resins, of the other binder resins described with respect to the aforesaid charge generating layer and charge transporting layer.

If desired, a protective layer may be provided on the charge transporting layer. A protective layer serves to prevent chemical denaturation of the charge transporting layer on charging and to improve mechanical strength of the photoreceptor.

If desired, a subbing layer may be provided between a conductive substrate and a photosensitive layer. A subbing layer functions to block injection of charge from the conductive substrate to the photosensitive layer at the time of charging and also serves as an adhesive layer to adhere and hold the conductive substrate and the photosensitive layer as a whole. In some cases, a subbing layer functions to prevent reflection of light on a conductive substrate.

Suitable materials for forming a subbing layer include binder resins, such as polyethylene resins, polypropylene resins, acrylic resins, methacrylic resins, polyamide resins, vinyl chloride resins, vinyl acetate resins, phenolic resins, polycarbonate resins, polyurethane resins, polyimide resins, vinylidene chloride resins, polyvinyl acetal resins, vinyl chloride-vinyl acetate copolymers, polyvinyl alcohol resins, water-soluble polyester resins, nitrocellulose, casein, gelatin, polyglutamic acid, starch, starch acetate, amino starch, polyacrylic acid, and polyacrylamide. In addition, zirconium chelate compounds, organotitanium compounds (e.g., titanyl chelate compounds and titanium alkoxides), and silane coupling agents may also be used.

A subbing layer is coated on a conductive substrate by a generally employed coating technique, such as blade coating, wire bar coating, spray coating, dip coating, bead coating, air knife coating, and curtain coating.

A subbing layer usually has a thickness of from 0.01 to 10 μm, and preferably from 0.05 to 2 μm.

The present invention will now be illustrated in greater detail with reference to Examples and Comparative Examples, but it should be understood that the present invention is not construed as being limited thereto. All the parts are by weight unless otherwise indicated.

EXAMPLE 1

A coating composition consisting of 10 parts of a zirconium compound (Orgatics ZC540, produced by Matsumoto Seiyaku Co., Ltd.), 1 part of a silane compound (A1110, produced by Japan Unicar Co., Ltd.), 40 parts of isopropyl alcohol, and 20 parts of butanol was applied to an aluminum substrate by dip coating and dried at 150° C. for 10 minutes to form a 0.1 μm thick subbing layer.

Five parts of X-type metal-free phthalocyanine crystals were mixed with 5 parts of a polyvinyl butyral resin (S-Lec BM-S, produced by Sekisui Chemical Co., Ltd.) and 90 parts of cyclohexanone, and the mixture was dispersed in a sand mill together with glass beads for 1 hour. The resulting coating composition was applied to the subbing layer by dip coating and dried by heating at 100° C. for 10 minutes to form a charge generating layer having a thickness of 0.25 μm.

In 80 parts of monochlorobenzene were dissolved 6 parts of Compound I-14 (triarylamine compound), 3 parts of Compound II-27 (benzidine compound), and 11 parts of polycarbonate having structural formula (VI) (viscosity-average molecular weight (My): 30,000), and the resulting coating composition was applied to the charge generating layer by dip coating and dried by heating at 115° C. for 1 hour to form a charge transporting layer having a thickness of 20 μm.

EXAMPLE 2

An electrophotographic photoreceptor was prepared in the same manner as in Example 1, except for replacing Compound I-14 with Compound I-27.

EXAMPLE 3

An electrophotographic photoreceptor was prepared in the same manner as in Example 1, except for replacing Compound I-14 with Compound I-4.

EXAMPLE 4

An electrophotographic photoreceptor was prepared in the same manner as in Example 1, except for replacing Compound I-14 with 3 parts of Compound I-13 and 3 parts of Compound III-20.

EXAMPLE 5

An electrophotographic photoreceptor was prepared in the same manner as in Example 1, except for replacing Compound I-14 with 4 parts of Compound I-13, 1 part of Compound III-20, and 1 part of Compound III-29.

EXAMPLE 6

An electrophotographic photoreceptor was prepared in the same manner as in Example 1, except for replacing Compound II-27 with Compound II-15.

EXAMPLE 7

An electrophotographic photoreceptor was prepared in the same manner as in Example 2, except for replacing Compound II-27 with Compound II-15.

EXAMPLE 8

An electrophotographic photoreceptor was prepared in the same manner as in Example 3, except for replacing Compound II-27 with Compound II-15.

EXAMPLE 9

An electrophotographic photoreceptor was prepared in the same manner as in Example 4, except for replacing Compound II-27 with Compound II-15.

EXAMPLE 10

An electrophotographic photoreceptor was prepared in the same manner as in Example 5, except for replacing Compound II-27 with Compound II-15.

EXAMPLE 11

An electrophotographic photoreceptor was prepared in the same manner as in Example 1, except that the coating composition for the charge transporting layer further contained 1 part of 2,6-di-t-butyl-4-methylphenol as an antioxidant.

EXAMPLE 12

An electrophotographic photoreceptor was prepared in the same manner as in Example 2, except that the coating composition for the charge transporting layer further contained 1 part of 2,2'-methylenebis(4-methyl-6-t-butylphenol) as an antioxidant.

EXAMPLE 13

An electrophotographic photoreceptor was prepared in the same manner as in Example 5, except that the coating composition for the charge transporting layer further contained 1 part of 2,2'-methylenebis(4-methyl-6-t-butylphenol) as an antioxidant.

COMPARATIVE EXAMPLE 1

An electrophotographic photoreceptor was prepared in the same manner as in Example 1, except for replacing Compound No. I-14 with Compound No. III-20.

COMPARATIVE EXAMPLE 2

An electrophotographic photoreceptor was prepared in the same manner as in Example 1, except for using no benzidine compound but 9 parts of Compound No. III-20 as a triarylamine compound.

COMPARATIVE EXAMPLE 3

An electrophotographic photoreceptor was prepared in the same manner as in Example 1, except for using no triarylamine compound but 9 parts of Compound No. II-15 as a benzidine compound.

COMPARATIVE EXAMPLE 4

An electrophotographic photoreceptor was prepared in the same manner as in Example 1, except for using no triarylamine compound but 9 parts of Compound No. II-27 as a benzidine compound.

Electrophotographic characteristics of the electrophotographic photoreceptors prepared in Examples 1 to 13 and Comparative Examples 1 to 4 were evaluated by using an electrostatic paper analyzer EPA-8000 (manufactured by Kawaguchi Denki Co., Ltd.) as follows.

The photoreceptor was charged to −6 kV by corona discharge under normal ambient conditions (20° C., 40% RH) and then exposed to monochromatic light of 800 nm isolated from light of a tungsten lamp by a monochromator and adjusted to an illuminance of 1 $\mu W/cm^2$. The initial surface potential $V_0$ (V) and half-value exposure $E_{1/2}$ ($erg/cm^2$) were measured. The photoreceptor was then exposed to white light of 10 lux for 1 second, and the residual potential $V_{RP}$ (V) was measured.

Further, the photoreceptor was mounted on a digital copying machine Able 3301, manufactured by Fuji Xerox Co., Ltd., and a copying test was carried on. The number of black spots appearing on the white background in the initial stage of copying was counted. After 30,000 copies were taken, the image quality was evaluated.

The results of the measurement and evaluation are shown in Table 4 below.

TABLE 4

| Example No. | Film Thickness (μm) | Electrical Characteristics in the Initial Stage $V_0$ (V) | $E_{1/2}$ ($erg/cm^2$) | $V_{RP}$ (V) | Number of Black Spots in the Initial Stage (10 cm × 10 cm) | Image Quality After Obtainina 30,000 Copies |
|---|---|---|---|---|---|---|
| Example 1 | 20.1 | −825 | 8.3 | −39 | 121 | Scratches developed due to abrasion after obtaining about 15,000 copies. |
| Example 2 | 19.4 | −795 | 7.4 | −34 | 98 | No defects. |
| Example 3 | 21.6 | −836 | 8.9 | −44 | 136 | No defects. |
| Example 4 | 19.5 | −800 | 7.6 | −36 | 88 | Scratches developed due to abrasion after obtaining about 15,000 copies. |
| Example 5 | 19.8 | −810 | 8.2 | −39 | 103 | No defects. |
| Example 6 | 21.3 | −829 | 8.7 | −46 | 82 | Scratches developed due to abrasion after obtaining about 10,000 copies. |
| Example 7 | 20.5 | −815 | 8.3 | −42 | 97 | No defects |
| Example 8 | 18.9 | −780 | 7.7 | −36 | 118 | Scratches developed due to abrasion after obtaining about 15,000 copies. |
| Example 9 | 20.3 | −815 | 8.6 | −44 | 80 | No defects. |
| Example 10 | 20.1 | −812 | 8.5 | −44 | 129 | Scratches developed due to abrasion after obtaining about 10,000 copies. |
| Example 11 | 20.4 | −820 | 8.3 | −42 | 48 | Scratches developed due to abrasion after obtaining about 10,000 copies. |
| Example 12 | 20.0 | −817 | 8.5 | −39 | 55 | No defects. |
| Example 13 | 19.8 | −798 | 8.2 | −44 | 62 | No defects. |
| Compara. Example 1 | 20.2 | −815 | 8.4 | −47 | 128 | Toner filming occurred. |
| Compara. | 20.7 | −820 | 9.2 | −66 | 77 | Toner filming occurred. |

TABLE 4-continued

| Example No. | Film Thickness (μm) | Electrical Characteristics in the Initial Stage $V_0$ (V) | $E_{1/2}$ (erg/cm$^2$) | $V_{RP}$ (V) | Number of Black Spots in the Initial Stage (10 cm × 10 cm) | Image Quality After Obtainina 30,000 Copies |
|---|---|---|---|---|---|---|
| Example 2 Compara. Example 3 | 19.7 | −790 | 7.9 | −55 | 125 | Fog developed after obtaining about 2,000 copies. |
| Compara. Example 4 | 20.0 | −815 | 6.9 | −30 | 158 | Fog developed after obtaining about 1,000 copies. |

As having been fully described and demonstrated, the electrophotographic photoreceptor according to the present invention containing specific charge transporting materials has high photosensitivity, causes little black spots in the initial stage of use, and maintains its electrophotographic characteristics stably even when used for obtaining tens of thousands of copies. For example, even after obtaining 30,000 copies, no toner filming due to insufficient cleaning takes place.

While the invention has been described in detail and with reference to specific examples thereof, it will be apparent to one skilled in the art that various changes and modifications can be made therein without departing from the spirit and scope thereof.

What is claimed is:

1. An electrophotographic photoreceptor comprising a conductive substrate having provided thereon a photosensitive layer, wherein said photosensitive layer contains, as charge transporting materials, (i) at least one triarylamine compound represented by formula (I)

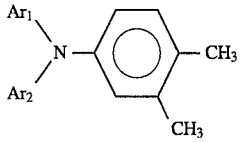

(I)

wherein $Ar_1$ and $Ar_2$ each represents a phenyl group which may be substituted with a substituent selected from the group consisting of an alkyl group, a phenyl group, an alkoxy group which may be substituted with a fluorine atom, an alkyl-substituted amino group and an alkyl-substituted phenyl group; a polycyclic aromatic group which may be substituted with an alkyl group; or an aromatic heterocyclic group; and (ii) at least one benzidine compound represented by formula (II)

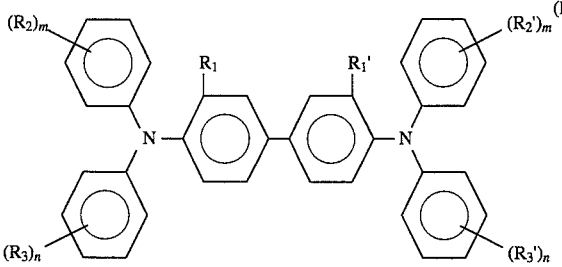

(II)

wherein $R_1$ and $R_1'$ are the same or different and each represents a hydrogen atom, a halogen atom, an alkyl group or an alkoxy group; $R_2$, $R_2'$, $R_3$ and $R_3'$ are the same or different and each represents a hydrogen atom; a halogen atom; an alkyl group; an alkoxy group; or a substituted amino group; and m and n each represents 1 or 2.

2. The electrophotographic photoreceptor as claimed in claim 1, wherein said photosensitive layer comprises at least a charge generating layer and a charge transporting layer, and said charge transporting layer contains said triarylamine compound of formula (I) and said benzidine compound of formula (II).

3. The electrophotographic photoreceptor as claimed in claim 1, wherein said photosensitive layer further contains an antioxidant.

4. The electrophotographic photoreceptor as claimed in claim 3, wherein said photosensitive layer comprises at least a charge generating layer and a charge transporting layer, and said charge transporting layer contains said triarylamine compound of formula (I), said benzidine compound of formula (II), and said antioxidant.

5. The electrophotographic photoreceptor as claimed in claim 3, wherein said antioxidant is at least one compound selected from the group consisting of hindered amine compounds and hindered phenol compounds.

6. The electrophotographic photoreceptor as claimed in claim 1, further comprising a triarylamine compound different from the triarylamine compound of formula (I) and represented by formula (III):

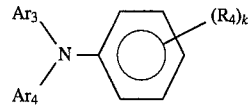

(III)

wherein $Ar_3$ and $Ar_4$ each represents a phenyl group which may be substituted with a substituent selected from the group consisting of an alkyl group, a phenyl group, an alkoxy group, an alkyl-substituted phenyl group, and a naphthyl group; $R_4$ represents an alkyl group having 1 to 4 carbon atoms or an alkoxy group; and k represents 0, 1 or 2.

7. The electrophotographic photoreceptor as claimed in claim 6, wherein the proportion of the triarylamine compound of formula (I) is at least 10% by weight based on the total weight of triarylamine compounds.

8. The electrophotographic photoreceptor as claimed in claim 6, wherein the proportion of triarylamine compound of formula (I) is 25% by weight or more of the total weight of triarylamine compounds.

9. The electrophotographic photoreceptor as claimed in claim 1, wherein the ratio of triarylamine compound of formula (I) and the benzidine compound of formula (II) is 10:90 to 90:10 by weight.

10. The electrophotographic photoreceptor as claimed in claim 1, wherein the ratio of the triarylamine compound of formula (I) and the benzidine compound of formula (II) is 30:70 to 90:10 by weight.

11. The electrophotographic photoreceptor of claim 1, further comprising a binder resin, wherein the ratio of the triarylamine compound and benzidine compound to the binder resin is from 30:70 to 60:40 by weight.

12. The electrophotographic photoreceptor as claimed in claim 1, further comprising a binder resin, wherein the ratio of the triarylamine compound and benzidine compound to the binder resin is from 35:65 to 50:50 by weight.

* * * * *